US012004596B2

(12) United States Patent
Polegato Moretti et al.

(10) Patent No.: US 12,004,596 B2
(45) Date of Patent: Jun. 11, 2024

(54) SHOE COMPONENT

(71) Applicant: GEOX S.p.A., Montebelluna (IT)

(72) Inventors: Mario Polegato Moretti, Crocetta del Montello (IT); Gianni Buratto, Covolo di Pederobba (IT); Massimo Zilio, Montebelluna (IT); Ivano Barbiero, Limena (IT); Livio Poloni, Caerano di San Marco (IT)

(73) Assignee: GEOX S.p.A., Montebelluna (IT)

( * ) Notice: Subject to any disclaimer, the term of this patent is extended or adjusted under 35 U.S.C. 154(b) by 170 days.

(21) Appl. No.: 17/123,432

(22) Filed: Dec. 16, 2020

(65) Prior Publication Data

US 2021/0177088 A1 Jun. 17, 2021

(30) Foreign Application Priority Data

Dec. 16, 2019 (IT) ..... 102019000024036

(51) Int. Cl.
*A43B 7/08* (2022.01)
*A43B 13/04* (2006.01)
*A43B 13/12* (2006.01)

(52) U.S. Cl.
CPC ..... *A43B 7/081* (2013.01); *A43B 13/04* (2013.01); *A43B 13/122* (2013.01)

(58) Field of Classification Search
None
See application file for complete search history.

(56) References Cited

U.S. PATENT DOCUMENTS 3,050,875 A * 8/1962 Robbins ..... A43B 7/06 36/3 B
3,418,731 A * 12/1968 Anciaux ..... A43B 17/08 36/30 R
4,078,321 A * 3/1978 Famolare, Jr. ..... A43B 13/223 36/3 B
4,364,186 A * 12/1982 Fukuoka ..... A43B 7/06 36/29
5,083,385 A 1/1992 Halford
6,082,824 A * 7/2000 Chow ..... A61G 5/1045 297/452.56

(Continued)

FOREIGN PATENT DOCUMENTS

CN 2433847 Y 6/2001
CN 108903135 A 11/2018

OTHER PUBLICATIONS

Chinese Office Action issued in Chinese Patent Application No. 202011485767.X dated Jul. 29, 2023, (w/ English Translation).

*Primary Examiner* — Jila M Mohandesi
(74) *Attorney, Agent, or Firm* — Oblon, McClelland, Maier & Neustadt, L.L.P.

(57) ABSTRACT

A shoe component includes a base structure which is substantially shaped so as to reproduce at least partially the sole of a foot of a user, the base structure having an upper surface which is designed to be directed toward the foot and a lower surface which is opposite the upper surface, the component comprising one or more through holes and one or more blind holes provided in the base structure. The one or more through holes are in communication with one or more of the one or more blind holes through one or more channels provided in the base structure.

13 Claims, 10 Drawing Sheets

(56) References Cited

U.S. PATENT DOCUMENTS

| | | | | |
|---|---|---|---|---|
| 6,553,690 | B2 * | 4/2003 | Di Girolamo | A43D 999/00 36/3 R |
| 7,475,497 | B2 * | 1/2009 | Hoffer | A43B 1/0009 36/3 R |
| 8,732,982 | B2 * | 5/2014 | Sullivan | A43B 13/188 36/3 R |
| 2001/0032400 | A1 * | 10/2001 | Brooks | A43B 23/22 36/102 |
| 2006/0156579 | A1 * | 7/2006 | Hoffer | A43B 13/186 36/28 |
| 2009/0178299 | A1 * | 7/2009 | Lafortune | A43B 21/26 36/35 B |
| 2014/0182170 | A1 * | 7/2014 | Wawrousek | A43B 5/02 702/155 |
| 2016/0345667 | A1 * | 12/2016 | Kohatsu | A43D 1/025 |

* cited by examiner

SHOE COMPONENT

The present invention relates to a shoe component.

As is known, a shoe is generally composed of an upper that wraps the foot and a sole which is joined to the upper.

Among its principal functions, the sole supports the weight of the user.

Generally, the sole comprises a tread, the function of which is to ensure traction on various different types of terrain, and which must be wear-resistant.

Such sole often also comprises a midsole made of a lighter and more shock-absorbing material with respect to the tread, which is located above the tread, for the purpose of deadening the impact of the foot of the user on the ground.

As an alternative, the sole can comprise a tread that has one or more cavities in an upward region which are delimited by the walls of the tread itself, and one or more inserts, made of a lighter and more shock-absorbing material than the tread, which are located in the cavity or cavities.

Nowadays soles are known that make shoes comfortable, not only by deadening the impact of the foot of the user on the ground and providing a support that is sufficient to support the weight of that user, but also by allowing, through openings and/or channels, a ventilation inside the shoe so as to keep the foot dry.

The use is known, for example, of the shoe described in U.S. Pat. No. 4,364,186, which is provided with a sole which comprises a tread which has a cavity formed on its upper surface and extending over the entire area of the foot.

The cavity is surmounted by an insert so as to define air chambers that are in communication with the inside of the shoe by way of ventilation openings.

Such air chambers are compressed by virtue of the weight of the user and the air is forced through holes provided in an insole, thus entering inside the shoe.

The above mentioned insert can also be made with a spongy material which is provided with vertical through holes that allow air to enter the shoe and which are in communication with each other through channels, which are arranged on the lower surface, which faces onto the tread.

This solution, although advantageous in certain aspects, is susceptible of improvements.

Consider, for example, that the holes in the insole are made over the entire surface in contact with the sole of the foot, without distinction, for example, between the forefoot and the heel.

This entails a movement of the air that is substantially undifferentiated between the forefoot and the heel, even though these two regions have completely different needs: the forefoot in fact is provided with a larger quantity of sweat glands and requires greater ventilation, while the heel is substantially lacking these glands.

Furthermore, even though there are the channels that connect the holes, the movement of the air inside the channels from the heel toward the forefoot is not particularly efficacious in that some holes in the heel region remain always open, so preventing the air from being forced into the channels.

Also known is the sole taught by U.S. Pat. No. 3,050,875, which comprises a tread, an intermediate layer and an insole.

The intermediate layer, made of a resilient material, is provided with a plurality of cavities arranged over the entire length of the sole, which are interconnected through passages that are V-shaped in cross-section and which close up under the effect of the weight of the user.

The aim is to prevent a reflux of the air pumped by the cavities of the heel toward the cavities of the toe, thus promoting a stream of air directed from the heel toward the toe of the foot.

The insole is used to facilitate assembly and to maintain the correct form of the assembled pieces.

This solution too, although advantageous, exhibits aspects that could be improved.

For example, the presence of passages with such a configuration structurally weakens the intermediate layer, subjecting it to the risk of deformations, so much so that an insole is necessary to ensure that the correct shape is maintained.

Furthermore, with the passing of time, the insole tends to subside, even only partially, into the passages that join the cavities, causing a reduction in comfort.

The aim of the present invention is to provide a shoe component that overcomes the drawbacks of the cited known art.

Within this aim, an object of the invention is to provide a shoe component that is capable of ensuring an optimal exchange of air inside the shoe that contains it while remaining structurally solid.

Another object of the invention is to provide a component that is capable of ensuring a ventilation that is differentiated according to the different regions of the foot.

Another object of the invention is to provide a component that is highly functional, easily and practically implemented and obtainable at low cost.

This aim and these and other objects which will become better apparent hereinafter are achieved by a shoe component, comprising a base structure which is substantially shaped so as to reproduce at least partially the sole of a foot of a user, said base structure having an upper surface which is designed to be directed toward said foot and a lower surface which is opposite said upper surface, said component comprising one or more through holes and one or more blind holes provided in said base structure, said component being characterized in that one or more of said through holes is in communication with one or more of said blind holes through one or more channels provided in said base structure.

Further characteristics and advantages of the invention will become better apparent from the description of preferred, but not exclusive, embodiments of a shoe component according to the invention, which are illustrated for the purposes of non-limiting example in the accompanying drawings wherein:

FIG. 1 is a view from above of a first embodiment of a component according to the invention;

FIG. 2*a* is a cross-sectional view of a portion of the component of FIG. 1, taken along the line II-II;

FIG. 2*b* is a view of a first variation of the portion of FIG. 2*a;*

FIG. 2*c* is a view of a second variation of the portion of FIG. 2*a;*

Figure 6:
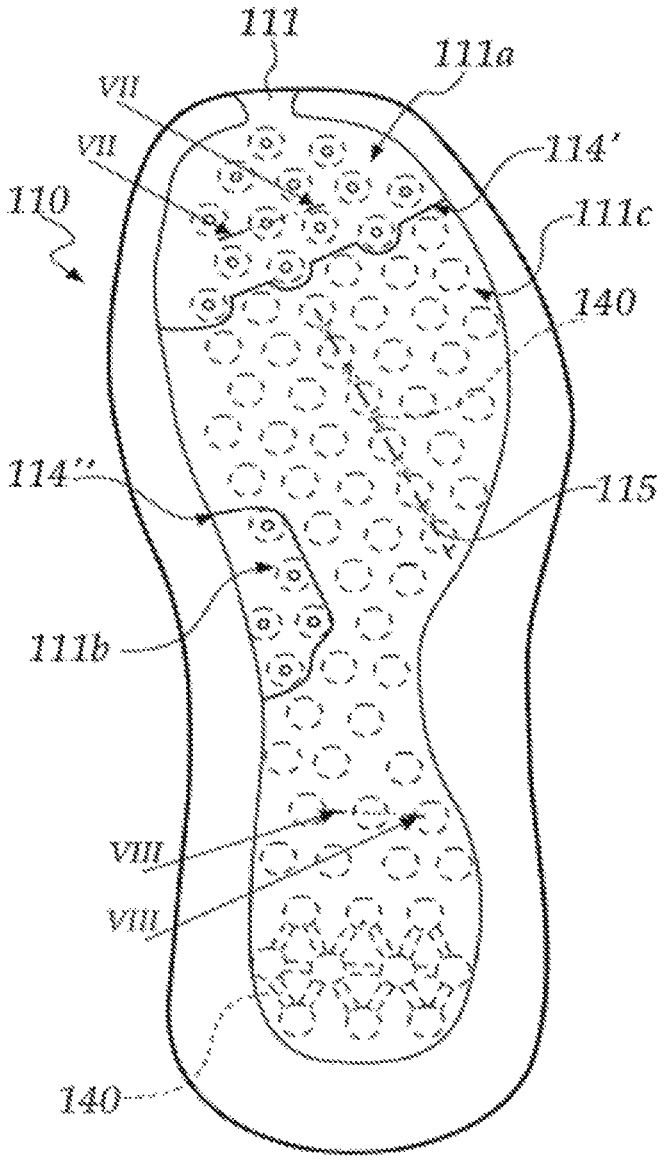
FIG. 6 is a view from above of a second embodiment of a component according to the invention.
Figure 7A:
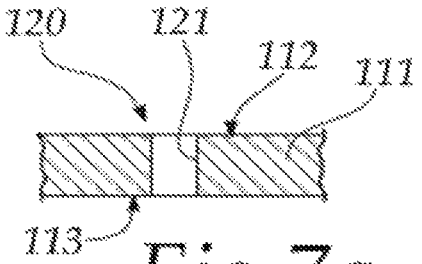
Figure 7B:
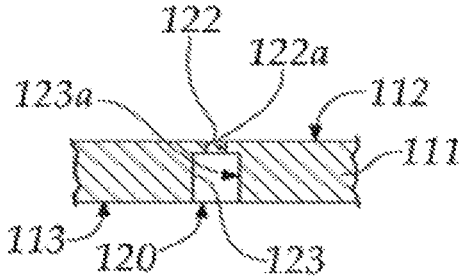

FIG. 7*a* is a cross-sectional view of a portion of the component of FIG. 6, taken along the sectional plane VII-VII;

FIG. 7*b* is a view of a first variation of the portion of FIG. 7*a;*

Figure 7C:
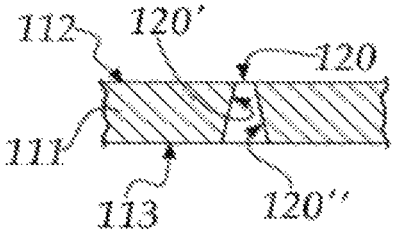

FIG. 7*c* is a view of a second variation of the portion of FIG. 7*a;*

Figure 8:
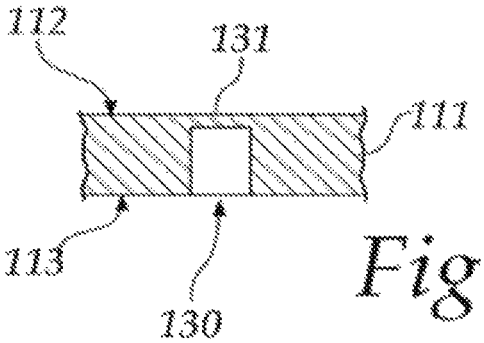
Figure 9A:
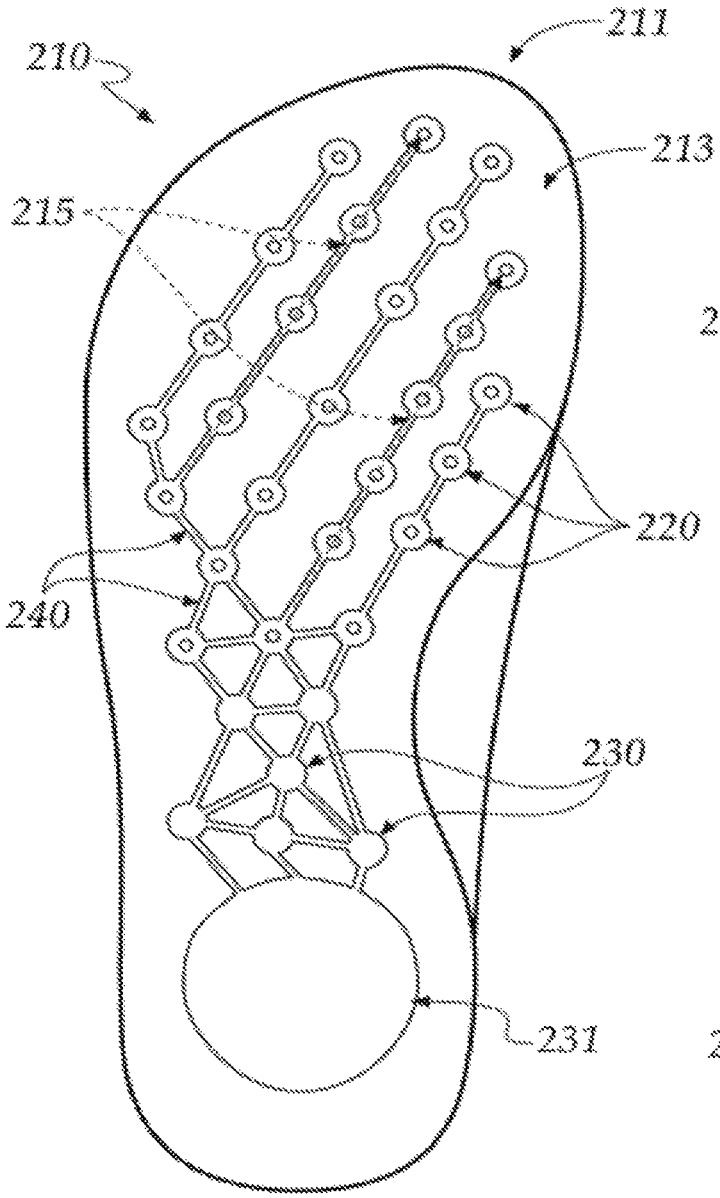
Figure 9B:
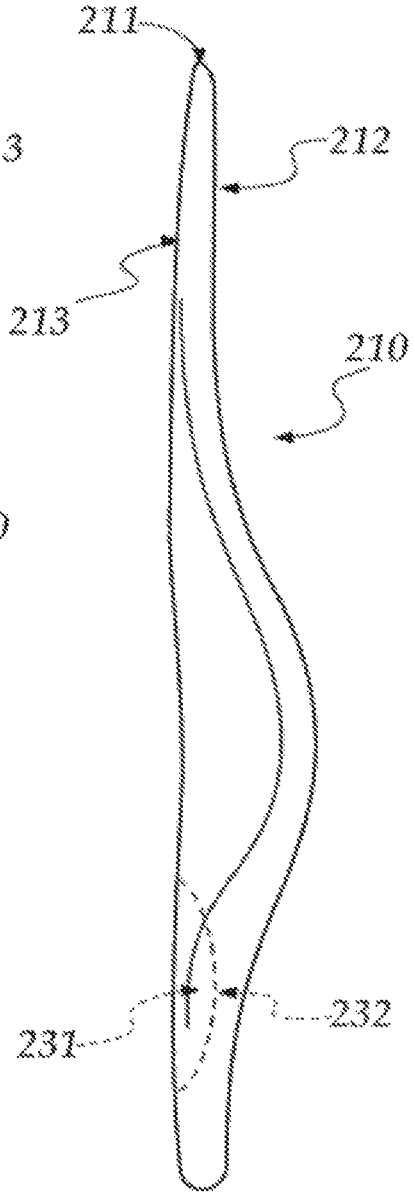
Figure 10A:
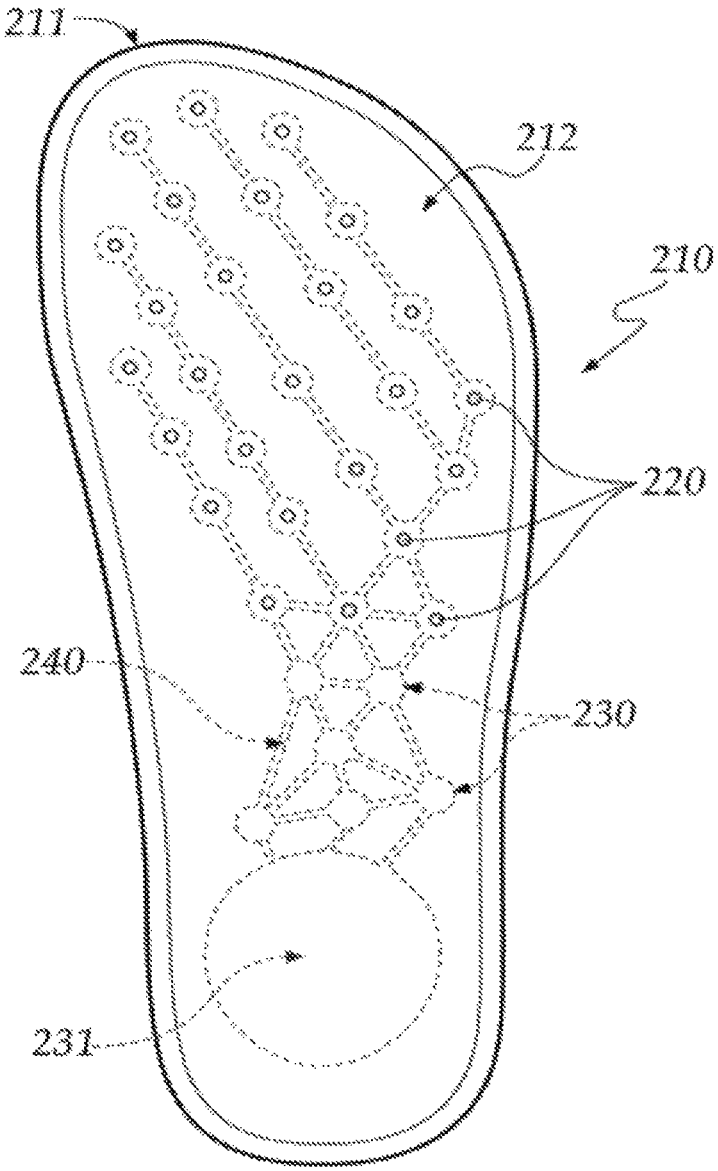
Figure 10B:
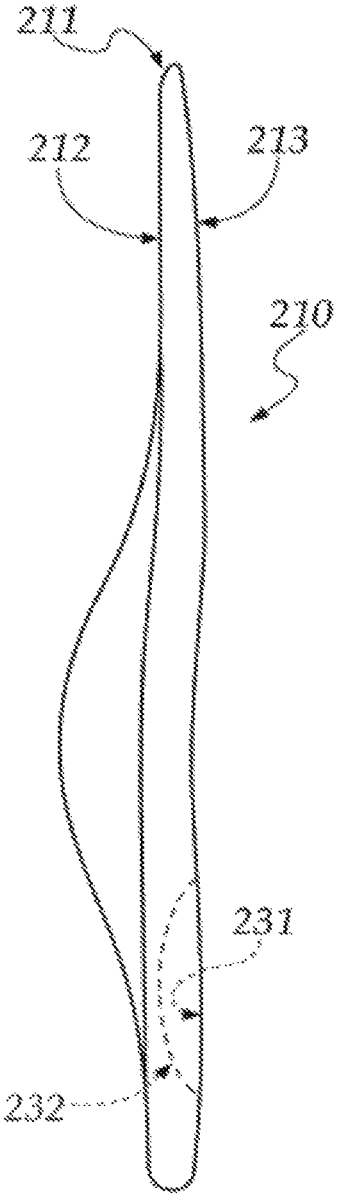
Figure 11A:
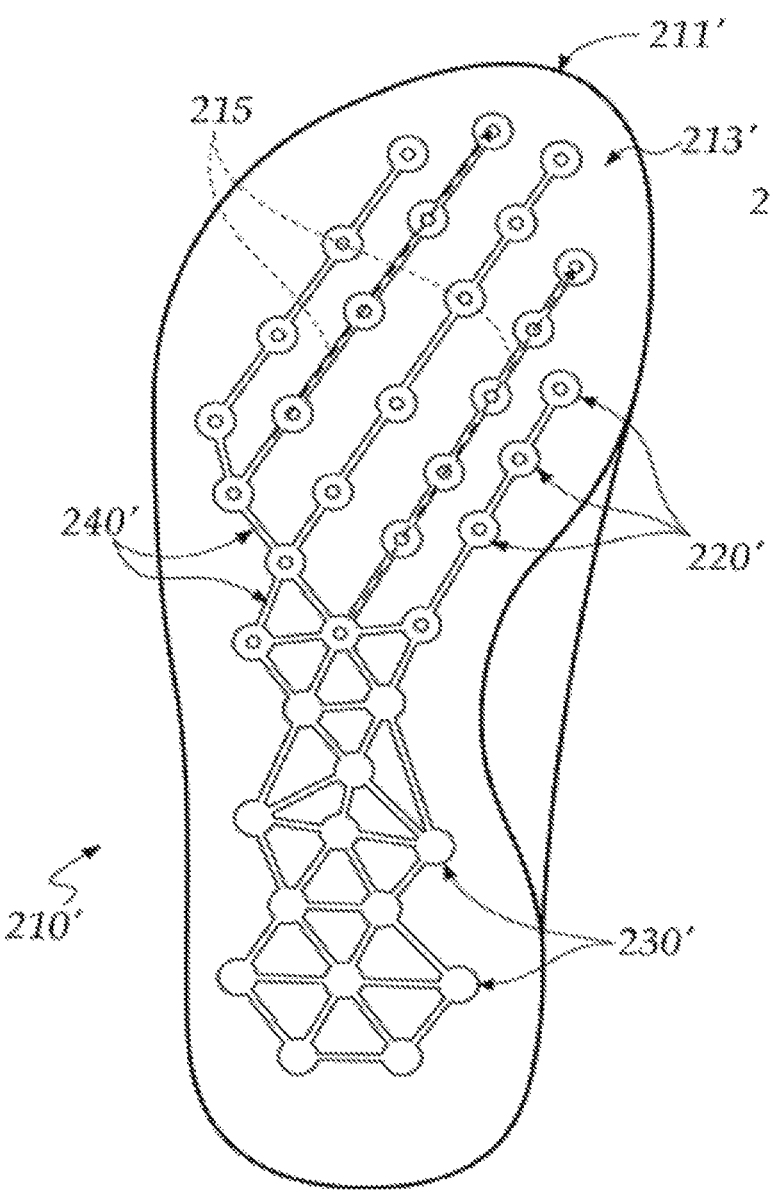
Figure 11B:
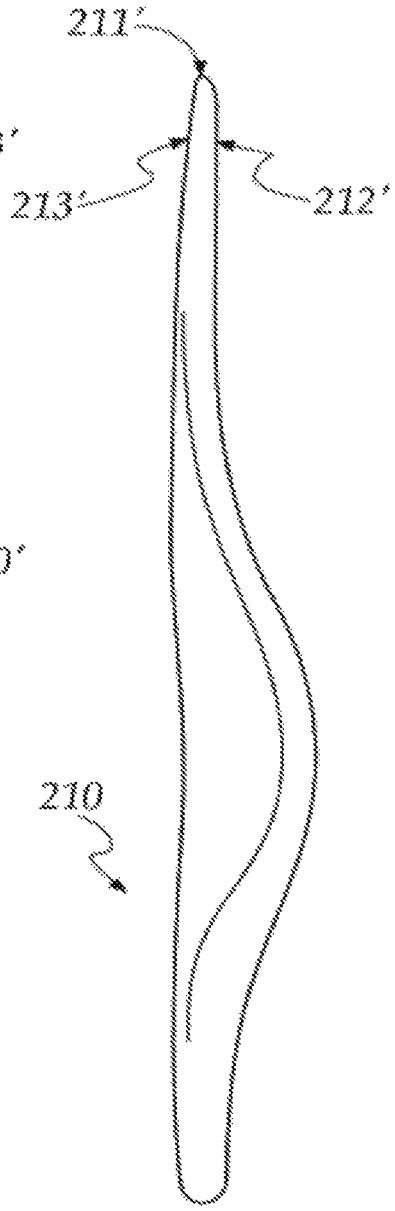
Figure 12A:
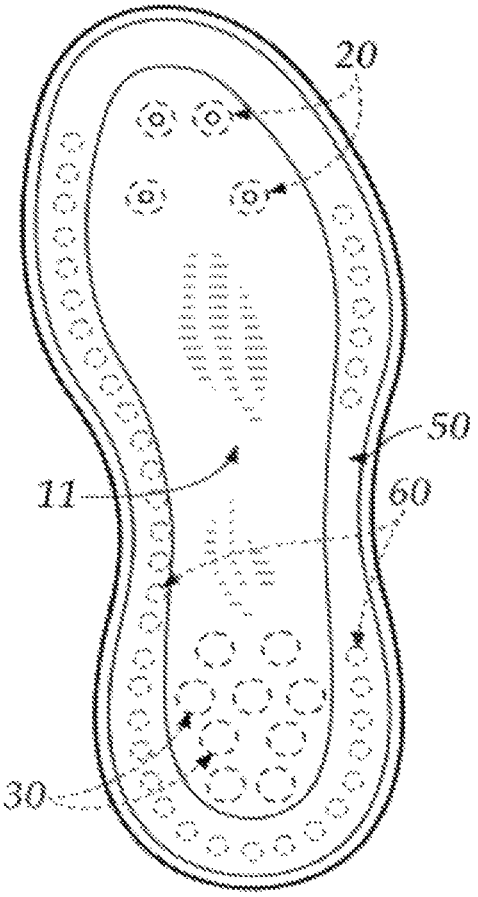
Figure 12B:
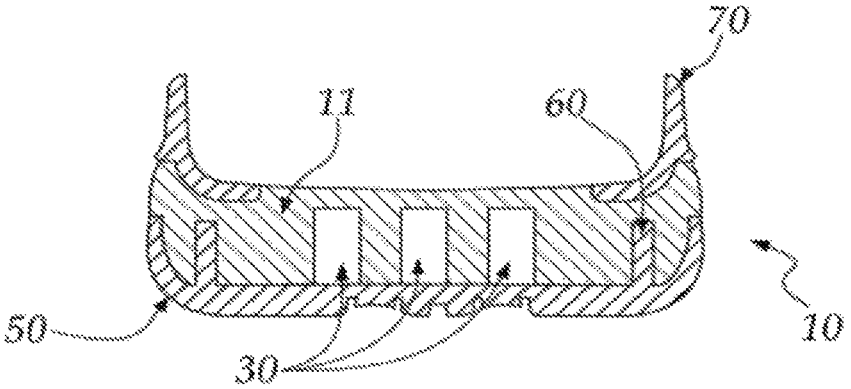
Figure 13A:
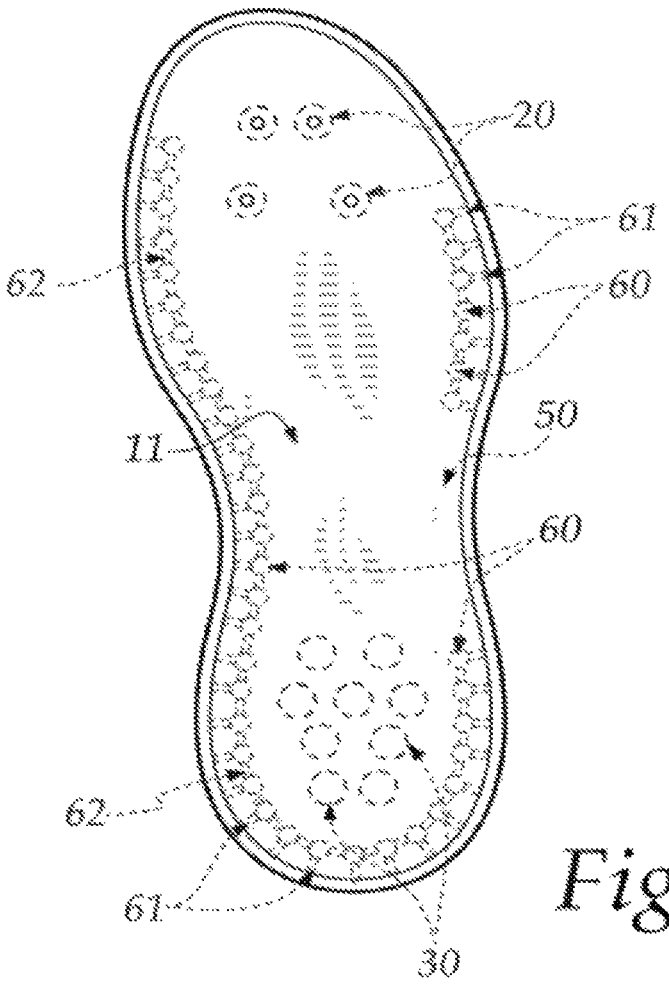
Figure 13B:
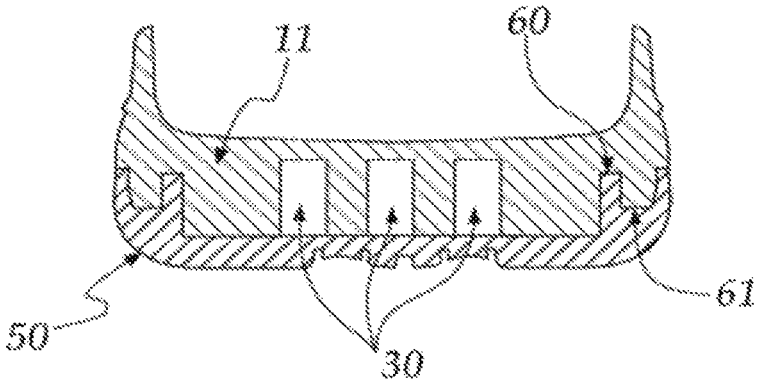
Figure 14:
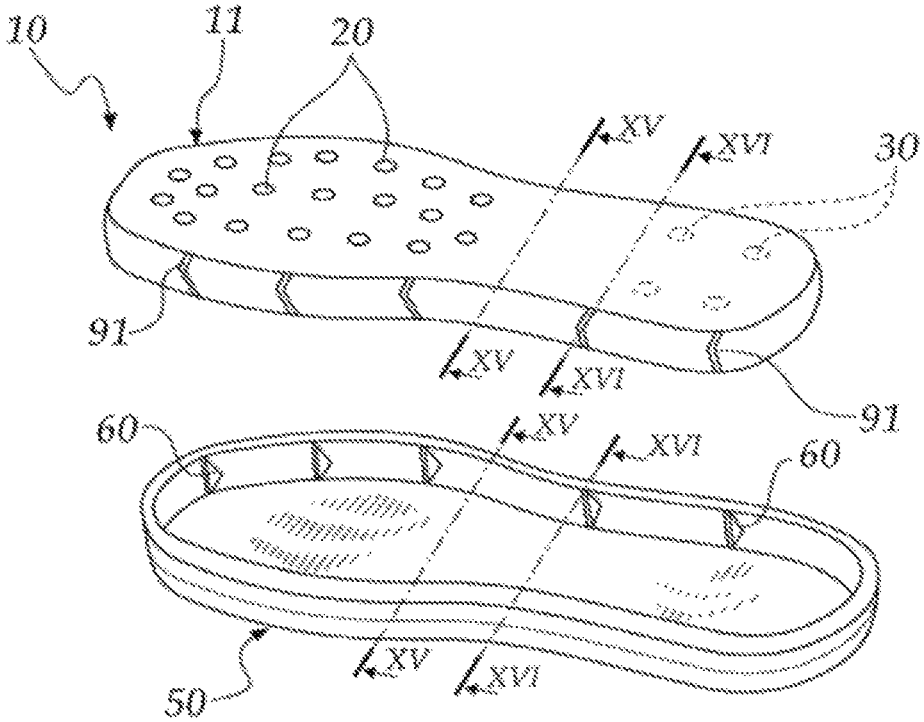
Figure 15:
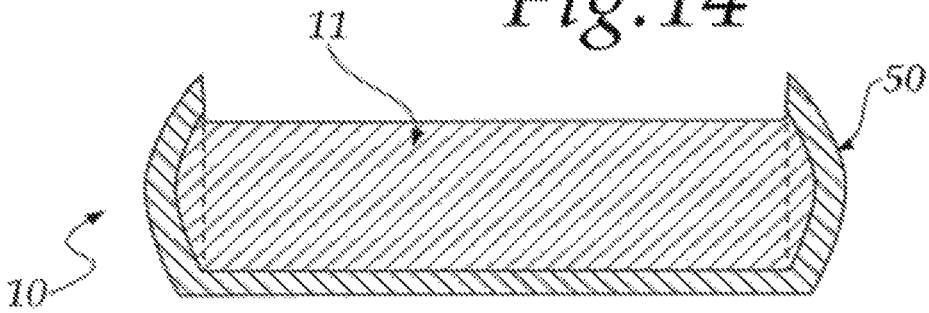
Figure 16:
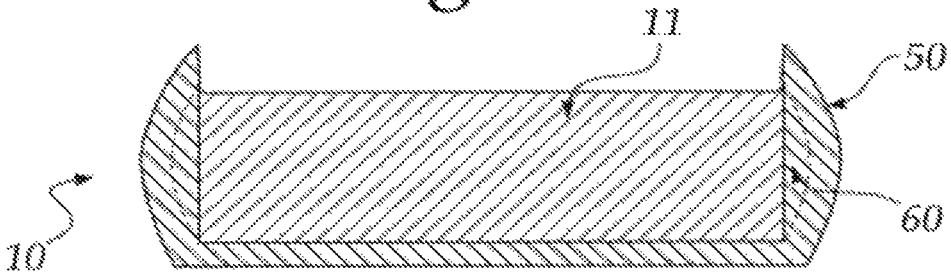

FIG. 8 is a cross-sectional view of a portion of the component of FIG. 6, taken along the sectional plane VIII-VIII;

FIG. 9*a* is a view from below of a third embodiment of a component according to the invention;

FIG. 9*b* is a side view from the inner foot side of a third embodiment of a component according to the invention;

FIG. 10*a* is a view from above of a third embodiment of a component according to the invention;

FIG. 10*b* is a side view from the outer foot side of a third embodiment of a component according to the invention;

FIGS. 11*a* and 11*b* are views of a variation of the third embodiment of a component according to the invention;

FIG. 12*a* is a view from above of a detail of a component, according to the invention, in a fourth embodiment;

FIG. 12*b* is a cross-sectional view of a component, according to the invention, in a fourth embodiment;

FIG. 13*a* is a view from above of a detail of a component, according to the invention, in a fifth embodiment;

FIG. 13*b* is a cross-sectional view of a component, according to the invention, in a fifth embodiment;

FIG. 14 is an exploded view of a sixth embodiment of a component according to the invention;

FIG. 15 is a cross-sectional view of the component of FIG. 14, not exploded, taken along the sectional plane XV-XV;

FIG. 16 is a cross-sectional view of the component of FIG. 14, not exploded, taken along the sectional plane XVI-XVI.

With reference to FIGS. 1 to 5, a shoe component according to the invention, provided according to a possible first embodiment, is generally designated with the reference numeral 10.

The component 10 comprises a base structure 11 which is substantially shaped so as to reproduce at least partially the sole of the foot of a user.

The base structure 11 is preferably made of polymeric material that is highly resilient, soft and light, for example constituted by expanded polyurethane (PU) and/or ethylene vinyl acetate (EVA), with thicknesses that vary preferably between approximately 3 mm, in the forefoot region, and approximately 100 mm, in the region of the rear foot.

Such base structure 11 has an upper surface 12, which in use is directed toward the foot of the user, and a lower surface 13, which is opposite thereto.

Advantageously, in the base structure 11 one or more through holes 20 are provided which pass through its entire thickness from the upper surface 12 to the lower surface 13, and one or more blind holes 30 are provided which extend only for part of the thickness of the base structure 11 and which open toward the lower surface 13.

The through holes 20 and the blind holes 30 are distributed on the base structure 11 according to a predefined pattern that follows differently the anatomy of the foot according to the embodiment being considered.

Figure 1:
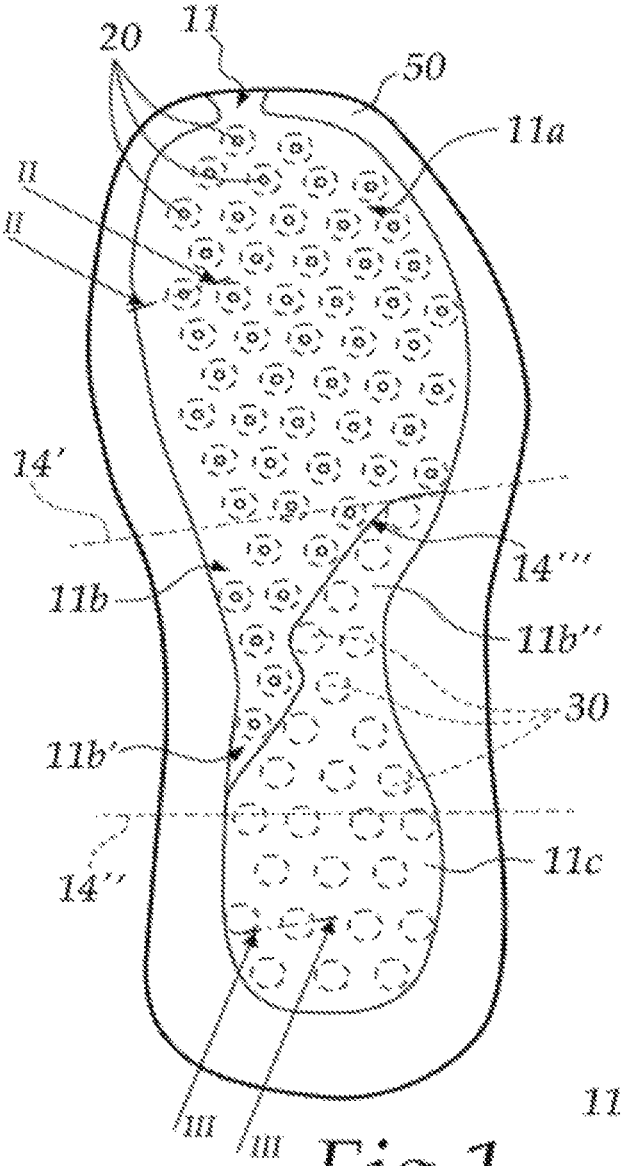

In this regard, it should be noted that the base structure 11 can ideally be subdivided into three portions which are delimited by a first imaginary line 14' and by a second imaginary line 14", as illustrated in FIG. 1.

More precisely, in the base structure 11 the following can be distinguished:

- a front portion 11*a*, i.e. a portion of the base structure 11 that substantially corresponds to the resting region of the forefoot,
- a median portion 11*b*, i.e. a portion of the base structure 11 that substantially corresponds to the resting region of the midfoot,
- a rear portion 11*c*, i.e. a portion of the base structure 11 that substantially corresponds to the resting region of the rear foot.

The front portion 11*a*, the median portion 11*b* and the rear portion 11*c* each extend for approximately one-third of the entire length of the base structure 11.

The median portion 11*b*, in turn, can ideally be subdivided along a third imaginary line 14'", which makes it possible to distinguish:

- an internal median portion 11*b'*, i.e. a portion of the base structure 11 that substantially corresponds to the resting region of the inner, or medial, part of the midfoot,
- an external median portion 11*b"*, i.e. a portion of the base structure 11 that substantially corresponds to the resting region of the outer, or lateral, part of the midfoot.

The internal median portion 11*b'*, and the external median portion 11*b"* have substantially the same area.

Given the above, as illustrated in FIG. 1, in this first embodiment the through holes 20 are arranged at the front portion 11*a* and at the internal median portion 11*b'*, i.e. they substantially affect the forefoot and the medial part of the midfoot, while the blind holes 30 are arranged at the rear portion 11*c* and at the external median portion 11*b"*, i.e. they substantially affect the rear foot and the lateral part of the midfoot.

The example illustrated here refers to through holes 20 and blind holes 30 that are substantially cylindrical and extend transversely to the upper surface 12 and to the lower surface 13.

However, it will be evident to the person skilled in the art that the shape and the direction of extension of such holes may be manifold.

Figure 2A:
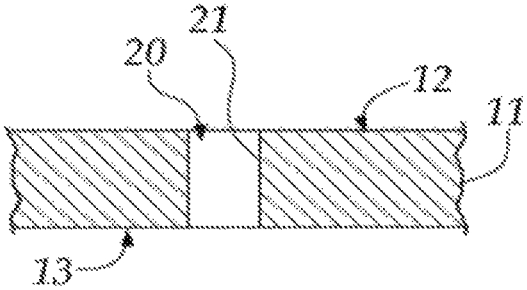
Figure 2B:
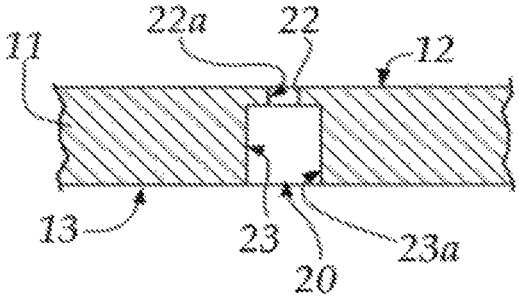

According to necessity and to technical requirements, the through holes 20 can be constant in cross-section 21, or almost so, along the entire thickness of the base structure 11, as illustrated in FIG. 2*a*, or they can comprise a first portion 22, with a reduced cross-section, which has a substantially circular cross-section 22*a* arranged proximate to the upper surface 12, and a second portion 23, constant in cross-section, or almost so, which has a substantially circular cross-section 23*a* and has a larger diameter than the diameter of the cross-section 22*a* of the first portion 22, defined proximally to the lower surface 13, as illustrated in FIG. 2*b*.

Figure 2C:
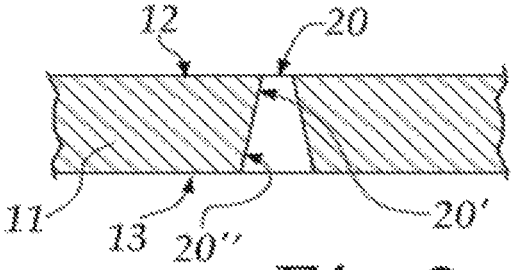

Alternatively, the through holes 20 can be substantially frustum-shaped, as illustrated in FIG. 2*c*, having a substantially circular upper cross-section 20' with a smaller diameter proximate to the upper surface 12, and a substantially circular lower cross-section 20" with a larger diameter proximate to the lower surface 13.

Embodiments like the ones illustrated in FIGS. 2*b* and 2*c* are particularly advantageous, for example, in shoes that use particularly thin components 10, since they make it possible to reduce the risk that the user might experience a sensation of giving way, and therefore of reduced comfort.

Furthermore, such embodiments, where the through holes 20 have a reduced cross-section, are also particularly advantageous because the reduction in cross-section contributes to locally accelerating the air flow, further improving the ventilation proximate to the upper surface 12 of the base structure 11.

In this case, the diameter of the portion that is substantially constant in cross-section 21, 23 is preferably comprised between approximately 5 mm and approximately 18 mm, while the diameter of the portion with a reduced cross-section 22 is preferably comprised between approximately 2 mm and approximately 18 mm, with thicknesses of the portion with a reduced cross-section 22 that vary preferably between approximately 2 mm and approximately 4 mm.

If the upper cross-section 20', shown in FIG. 2*c*, is substantially frustum-shaped, it has a diameter preferably comprised between approximately 2 mm and approximately 4 mm, while the lower cross-section 20" has a diameter preferably comprised between approximately 4 mm and approximately 18 mm.

Figure 3:
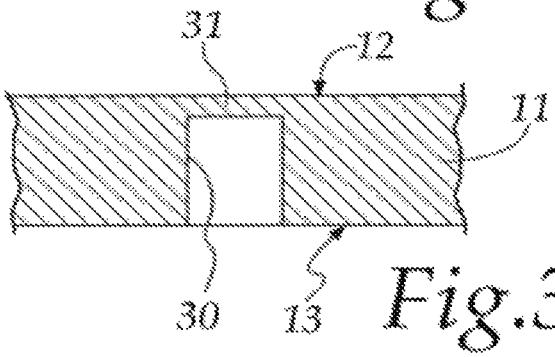
FIG. 3 is a cross-sectional view of a portion of the component of FIG. 1, taken along the sectional plane III-III.

The blind holes 30, on the other hand, have a cross-section that is predominantly constant, as illustrated in FIG. 3, and their diameter varies preferably between approximately 5 mm and approximately 18 mm; they are separated from the upper surface 12 by way of a wall 31 of thickness preferably comprised between approximately 2 mm and approximately 4 mm.

According to the invention, the component 10 comprises one or more channels 40 provided in the base structure 11, which place one or more through holes 20 and one or more blind holes 30 in communication with each other, in such a manner as to create, while walking, an almost continuous air flow from the rear foot toward the forefoot, as better explained below.

Figure 4:
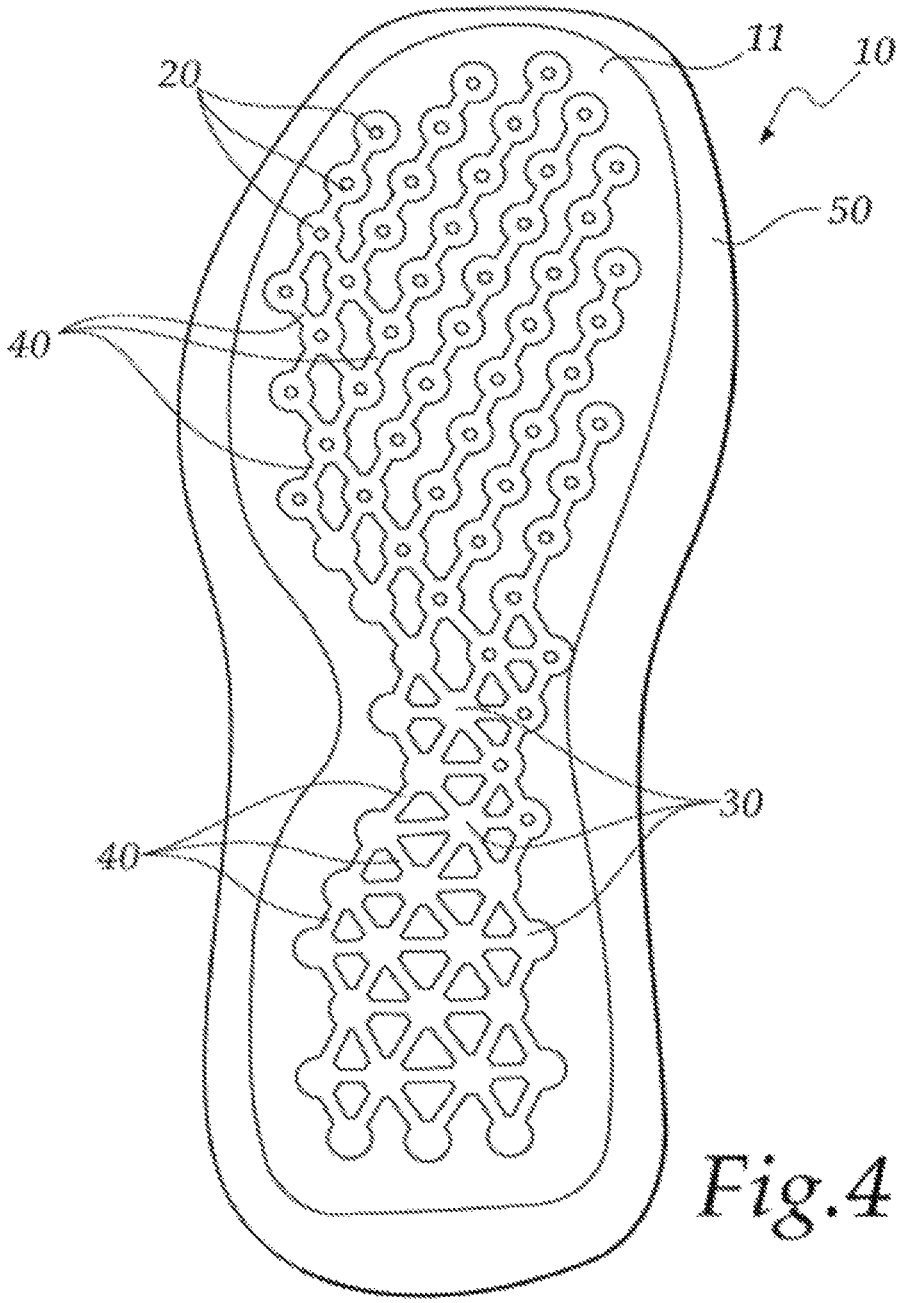
FIG. 4 is a view from below of the component of FIG. 1.
Figure 5:
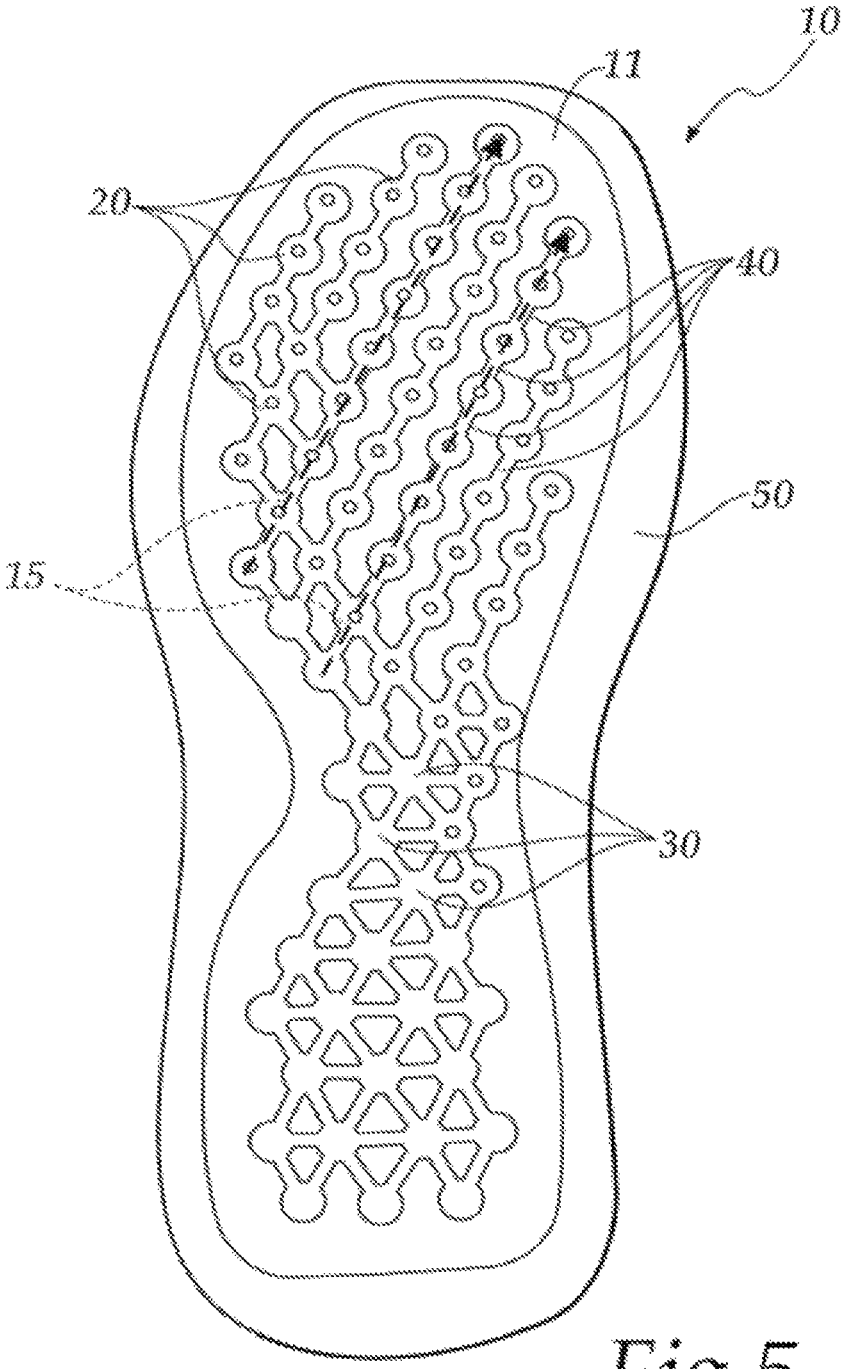
FIG. 5 is another view from below of the component of FIG. 1.

Such channels 40 open out toward the lower surface 13 of the base structure 11, i.e. toward the surface that when in use is arranged away from the foot of the user, as shown in FIGS. 4 and 5.

This solution is particularly advantageous in that it makes it possible to reduce to the minimum the points of discontinuity on the upper surface 12 of the base structure 11, thus increasing the surface that can be used for gluing an optional insole, and decreasing the risk of its collapsing, even only partially, under the weight of the user causing a reduced feeling of comfort.

The channels 40 are preferably semicylindrical and their diameter is preferably comprised between approximately 3 mm and approximately 10 mm.

According to a preferred embodiment, as an alternative to the preceding embodiment, not shown in the figures, the channels 40 have a quadrangular cross-section of which the short sides and the long sides measure respectively from approximately 1 mm to approximately 3 mm and from approximately 3 mm to approximately 6 mm.

During the gait, the weight of the user acts first on the rear portion 11*c*, which is provided almost exclusively with blind holes 30, and, while the gait action proceeds, the weight is shifted toward the median portion 11*b* and toward the front portion 11*a*, where the through holes 20 are located.

In practice, a compression is carried out of the air contained in the blind holes 30, which, under the thrust of the foot, is conveyed in the direction of the forefoot through the channels 40.

Given the characteristics of the blind holes 30, there is practically no outflow of air at the resting region of the rear foot, therefore the pressure losses of the stream of air pushed from the rear foot toward the forefoot are substantially negligible.

When the air reaches the front portion 11*a* and the internal median portion 11*b*' it can rise, through the through holes 20, toward the upper surface 12 of the base structure 11, where the forefoot and the inner part of the midfoot rest, i.e. the areas of the foot that are richest in sweat glands and therefore more subject to sweating.

Since at the rear portion 11*c* and at the external median portion 11*b*" the air cannot exit through the blind holes 30, except in negligible amounts, in such regions there can be multiple channels 40 that branch out from, or converge in, a single blind hole 30, with respect to the arrangement in the front portion 11*a* and in the internal median portion 11*b*' for the through holes 20.

Such contrivance allows a better distribution of the air, while avoiding local pressure increases that could cause unsightly swellings and cause a feeling of reduced comfort and/or of instability during the gait.

As illustrated in FIG. 5, a part of the channels 40 extends substantially from the external median portion 11*b*" toward the front portion 11*a*, according to a predominant direction of extension 15 which is oriented substantially from the resting region of the lateral side of the foot toward the resting region of the medial side of the foot, basically following the second and third steps of the natural walking movement of the foot.

In this regard, consider that for a walking user, there are substantially three phases in placing the foot on the ground:

- a first phase, in which the rear heel makes contact with the ground, also known as the taligrade phase;
- a second phase, which corresponds to the classic resting on the rear and front heels, and on the lateral margin of the foot, also known as the plantigrade phase;
- a third phase, of resting only on the front heel, with progressive release of the resting on the metatarsal heads from the outside inward, also known as the digitigrade phase. The distribution of the channels 40 along the predominant direction of extension 15 is therefore found to be particularly advantageous, in that it favors the outflow of the air contained in them through the through holes 20 gradually, following the natural gait of the foot.

Otherwise, local buildups of air could occur, with consequent local pressure increases that could cause unsightly swellings and cause a reduction in comfort and/or instability during the gait.

In this first embodiment illustrated in FIGS. 1 to 5, all the through holes 20 and the blind holes 30 are connected by the channels 40.

However, in embodiments not shown it is possible that one or more through holes 20 and/or one or more blind holes 30 are isolated, i.e. are not connected to adjacent holes through the channels 40.

This could be done, for example, in order to simplify the construction of the molds by means of which the component 10 is made, while still ensuring an efficacious ventilation.

In such cases, it is possible that at least approximately 60% of the through holes 20 and of the blind holes 30 are connected by the channels 40.

Alternatively, at least approximately 70% of the through holes 20 and of the blind holes 30 can be connected by the channels 40.

Alternatively, at least approximately 80% of the through holes 20 and of the blind holes 30 can be connected by the channels 40.

Alternatively, at least approximately 90% of the through holes 20 and of the blind holes 30 can be connected by the channels 40.

Advantageously, the component 10 also comprises a surrounding element 50 that covers at least partially the perimeter of the base structure 11.

Advantageously the surrounding element 50 can also cover below the base structure 11, that is to say that the element 50 can comprise a tread for contact with the ground.

This solution is advantageous since it makes it possible to produce the base structure 11 with the minimum possible density, for example comprised between approximately 0.2 and approximately 0.6 g/cm$^3$, and/or the minimum possible hardness, for example comprised between approximately 30 and approximately 80 Asker C, and join it to the surrounding element 50 which is made of a more rigid material, for example polyurethane or thermoplastic polyurethane, for short PU and TPU, of hardness comprised between approximately 60 and approximately 90 Shore A and/or density comprised between approximately 0.9 and approximately 1.3 g/cm$^3$.

In this manner, an assembled component 10 can be obtained for use for example as a midsole, which already comprises a tread or to which a tread is subsequently to be joined in order to form a sole for shoes, which is extremely comfortable but at the same time sufficiently solid.

In any case, it is also possible to make a midsole with just the base structure 11 conveniently dimensioned.

It is furthermore possible to make the component 10 with a base structure 11 which has different hardnesses and/or densities in the various regions, according to necessity and technical requirements.

In particular, it is possible to have a greater hardness and/or density at the portions where the blind holes 30 are provided and a lesser hardness and/or density at the portions where the through holes 20 are provided.

For example, in a preferred embodiment, the base structure 11 has a hardness:

- comprised between approximately 60 and approximately 80 Asker C at the portions where the blind holes 30 are provided,
- comprised between approximately 30 and approximately 50 Asker C at the portions where the through holes 20 are provided.

In a possible second embodiment illustrated in FIGS. 6 to 8, the shoe component according to the invention is generally designated with the reference numeral 110, while the elements substantially corresponding to elements of the first embodiment have been designated with the same reference numerals increased by 100.

In the component 110, a first imaginary line 114' and a second imaginary line 114" delimit ideally:

- a toe portion 111*a*, i.e. a portion of the base structure 111 that substantially corresponds to the resting region of the toe of the foot,
- an internal central portion 111*b*, i.e. a portion of the base structure 111 that substantially corresponds to the resting region of the internal plantar arch of the foot,
- a complementary portion 111*c*, i.e. the remaining part of the base structure 111.

In this second embodiment, the through holes 120 are provided in the toe portion 111*a* and in the internal central portion 111*b*, while the blind holes 130 are provided in the complementary portion 111*c*.

The toe portion 111*a* and the internal central portion 111*b* can be present simultaneously, or only one of the two can be present.

These embodiments are advantageous because they make it possible to maximize the ventilation in one or more of the aforementioned portions, where the load applied owing to the weight of the user is lighter.

As is known, in fact, the foot rests mainly on the heel, at the calcaneus, and along the external plantar arch up to the head of the fifth metatarsal, therefore the toe portion 111*a* and the internal central portion 111*b* support a lighter load and therefore are particularly indicated for maximizing ventilation.

In a possible third embodiment, the shoe component according to the invention is substantially a removable insole, illustrated in various views in FIGS. 9*a*, 9*b*, 10*a* and 10*b*.

With reference to those figures the shoe component, designated by the reference numeral 210, comprises a base structure 211 in which one or more through holes 220 are provided which pass through its entire thickness from the upper surface 212 to the lower surface 213, and one or more blind holes 230 are provided which extend only for a part of the base structure 211 and which open toward the lower surface 213.

In particular, at the heel on the base structure 211 there is a single blind hole 231, the diameter of which is preferably comprised between approximately 10 and approximately 25 mm.

Advantageously the blind hole 231 is delimited, toward the lower surface 213, by a rounded surface 232, for example convex.

This embodiment is advantageous because it makes it possible to take advantage of the maximum load available to promote the air flow.

At the heel, in fact, the load applied by the weight of a user reaches the maximum value.

The rounded shape of the surface 232 is, on the other hand, advantageous because it makes it possible to avoid points where the air can stagnate and because it confers greater comfort, avoiding the perception of edges during the gait.

A variation of the third embodiment is shown in a view from below in FIG. 11*a* and in a side view from the inner foot side in FIG. 11*b*.

With reference to those figures, the shoe component, designated by the reference numeral 210', comprises a base structure 211' in which one or more through holes 220' are provided which pass through its entire thickness from the upper surface 212' to the lower surface 213', and one or more blind holes 230' are provided which extend only for part of the base structure 211' and which open toward the lower surface 213'.

This variation is particularly advantageous, for example, when the thickness of the base structure 211' is not sufficiently high to be able to provide a single blind hole at the heel.

As shown in FIGS. 9*a* and 11*a*, a part of the channels 240 and 240' extends advantageously according to a predominant direction of extension 215 and 215' which is oriented substantially from the resting region of the lateral side of the foot toward the resting region of the medial side of the foot.

Furthermore the blind holes 230, 230' and the through holes 220, 220' can have the same shape described above with reference to the first embodiment.

FIG. 12*a* is a view from above of a possible embodiment of the surrounding element 50.

In such embodiment, the surrounding element 50 comprises one or more tabs 60, made in a single piece with the rest of the element 50 and arranged substantially proximate to the external perimeter thereof.

The hardness of the tabs 60 is, therefore, substantially equal to the hardness of the element 50 and greater than the hardness of the base structure 11.

In the above mentioned embodiment, the tabs 60 correspond to support columns.

The tabs 60 are particularly advantageous because they limit the lateral movement of the base structure 11 owing to the shear component of the load bearing thereon.

Furthermore the tabs 60 limit the overall lowering of the set constituted by the base structure 11 and by the element 50 subjected to the action of a vertical load.

As a consequence greater stability is obtained along with a greater level of comfort perceived by the user.

FIG. 12*b* is a cross-sectional view proximate to the heel of the component 10 for a shoe that comprises the element 50 provided with tabs 60 of FIG. 12*a*, the base structure 11, with the blind holes 30 and an additional upper element 70, which is particularly advantageous for aesthetic reasons and/or to give additional stability to a shoe that comprises such component 10.

In a variation of embodiment, illustrated in FIGS. 13*a* and 13*b*, each tab 60 is joined to the internal side wall of the perimetric edge of the element 50, the one directed toward the base structure 11, by a first crossmember 61, which is also made in a single piece with the rest of the element 50.

The first crossmember 61 is particularly advantageous because it keeps the perimetric edge of the element 50 joined to the tab 60, preventing it from excessive distancing, a possible cause of detachment between the element 50 and the base structure 11 under conditions of high load.

The first crossmember 61 constitutes, with the respective tab 60, a ramification of the surrounding element 50 that penetrates into the base structure 11, rendering the coupling between the latter and the element 50 more solid and durable even in presence of numerous cycles of application and removal of the load.

In this manner the lateral movement of the surrounding element 50 is limited when the latter is subjected to the thrust of the base structure 11 on which the weight of the user bears.

Also, there can be a plurality of second crossmembers 62, each one for connection between two respective tabs 60.

In particular, such second crossmembers 62 are also made in a single piece with the rest of the surrounding element 50 and are adapted to provide additional support to the latter, for example when the hardness of the material that constitutes the surrounding element 50 is much lower with respect to the hardness of the material that constitutes the base structure 11.

These second crossmembers 62 make it possible for the tabs 60 to regain the inactive position, i.e. when no loads are applied, once the load applied decreases or ceases altogether.

The tabs 60 and the first crossmembers 61 are advantageously arranged in the places that are most adapted according to the use of a shoe that comprises the component 10 with the base structure 11 and the surrounding element 50.

For example, the tabs 60 and the first crossmembers 61 can be arranged substantially proximate to the perimetric edge of the surrounding element 50, leaving free a neighborhood of the toe of the foot and the inner region of the midfoot, as shown in FIG. 13*a*.

Such tabs 60 are preferably cylindrical or frustum-shaped, with:

- a diameter, at the point closest to the upper surface of the base structure 11, preferably comprised between approximately 1.5 and approximately 5 mm,
- a height that is determined so that their upper surface is located at not less than approximately 2 mm from the upper surface of the base structure 11.

Such a height ensures that, even under conditions of maximum load, the tabs 60 are not felt by a user, who otherwise could notice a sensation of discomfort or of pain.

The thickness of the first crossmembers 61 and of the second crossmembers 62 is preferably comprised between approximately 1.5 and approximately 4 mm.

The first crossmembers 61 and the second crossmembers 62 have a height extension that is preferably lower than the height of the tabs 60.

More preferably the difference between the height extension of the tabs 60 and that of the first crossmembers 61 and of the second crossmembers 62 is comprised between approximately 1 and approximately 4 mm.

This makes it possible not to increase the weight of the surrounding element 50 too much, since it is constituted by polymeric material that usually has a specific weight that exceeds that of the polymeric material of which the base structure 11 is constituted.

FIG. 14 shows a sixth embodiment of the component 10, according to the invention, which comprises the base structure 11 and the surrounding element 50.

In such embodiment, the surrounding element 50 comprises one or more tabs 60, arranged proximate to the external perimetric edge and located on the surface of the element 50 that faces the perimetric edge of the base structure 11.

The tabs 60 are made in a single piece with the surrounding element 50 and therefore have substantially the same hardness.

In the above mentioned embodiment, the tabs 60 correspond to strengthening wings.

At such tabs 60 there are, on the base structure 11, corresponding seats 91 for accommodating the latter, which are shaped complementarily thereto.

In order to provide the element 50, it is possible, for example, to use a first mold and subsequently place it in a second mold, pouring into it the thermally stable polymeric material such as for example polyurethane (PU) which constitutes the base structure 11.

FIGS. 15 and 16 show two different cross-sections of the component 10, respectively taken along the sectional planes XV-XV and XVI-XVI of FIG. 14.

In practice it has been found that the invention fully achieves the intended aim and objects by providing a shoe component that makes it possible to create, during the gait, an almost continuous air flow from the rear foot toward the forefoot, in this manner ensuring an optimal exchange of air inside the shoe that contains it.

In particular, at the forefoot a flow of air is created that promotes ventilation right at the areas of the foot that are richer in sweat glands and which therefore are more subject to sweating.

Furthermore, the presence of through holes and blind holes of reduced dimensions with respect to the width of the component itself, which are distributed evenly from the forefoot toward the rear foot, makes it possible to move a volume of air that is not negligible while avoiding, with respect to known solutions, having cavities of dimensions such as to expose the foot arranged above to the component to the risk of subsiding under the action of the weight of the user.

The invention thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. 102019000024036 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A shoe component, comprising:

a base structure which is substantially shaped so as to reproduce at least partially the sole of a foot of a user, said base structure having an upper surface which is designed to be directed toward said foot and a lower surface which is opposite said upper surface; and one or more through holes and one or more blind holes provided in said base structure, wherein one or more of said one or more through holes is in communication with one or more of said one or more blind holes through one or more channels provided in said base structure, wherein the base structure includes a front portion, a median portion, and a rear portion, wherein only through holes are arranged at the front portion of said base structure, wherein only blind holes are arranged at the rear portion of said base structure, and wherein the median portion includes both blind holes at an external median portion of said base structure and through holes at an internal median portion of said base structure.

2. The shoe component according to claim 1 wherein one or more channels at the front portion of the base structure are oriented at an angle between 0 degrees and 90 degrees with respect to a longitudinal axis direction of the shoe component.

3. The shoe component according to claim 1, wherein each one of said one or more through holes comprises at least one portion that is constant in cross-section.

4. The shoe component according to claim 3 wherein said portion that is constant in cross-section has a substantially cylindrical shape, a diameter of said portion that is constant in cross-section being between approximately 5 mm and approximately 18 mm.

5. The shoe component according to claim 1 wherein part of said one or more through holes have a reduced cross-section which is defined proximally to said upper surface.

6. The shoe component according to claim 5 wherein said reduced cross-section has a diameter between approximately 2 mm and approximately 18 mm.

7. The shoe component according to claim 1 wherein each one of said one or more blind holes has a substantially cylindrical shape, a diameter of said one or more blind holes being between approximately 5 mm and approximately 18 mm, said one or more blind holes being separated from said upper surface by a wall having a thickness between approximately 2 mm and approximately 4 mm.

8. The shoe component according to claim 1 wherein said one or more blind holes are arranged at a rear portion of said base structure and at an external median portion of said base structure.

9. The shoe component according to claim 1 wherein each one of said channels has a substantially semicylindrical shape with the concavity directed toward said lower surface, the diameter of said channels being between approximately 3 mm and approximately 10 mm.

10. The shoe component according to claim 1 wherein a percentage by number of said one or more through holes that are in communication with said one or more blind holes through one or more of said channels varies between at least approximately 60% and at least approximately 90%.

11. The component according to claim 1 wherein a part of said channels extends along a predominant direction of extension which is oriented substantially from a resting region of a lateral side of said foot toward a resting region of a medial side of said foot.

12. The shoe component according to claim 1 wherein at least one from among said front portion, and said internal median portion, at which said one or more through holes are defined, has a different hardness and/or density with respect to at least one from among said rear portion, said external median portion, and said complementary portion, at which said one or more blind holes are defined.

13. The shoe component according to claim 1, further comprising at least one surrounding element which is adapted to cover at least partially a perimetric region of said base structure, said surrounding element being made of a material with a hardness and/or density that is different with respect to the material of which said base structure is made.

* * * * *